US005271826A

United States Patent [19]

Krambeck et al.

[11] Patent Number: 5,271,826

[45] Date of Patent: Dec. 21, 1993

[54] CATALYTIC CRACKING OF COKE PRODUCING HYDROCARBONS

[75] Inventors: Frederick J. Krambeck, Cherry Hill; Donald M. Nace, Woodbury; Paul H. Schipper, Wilmington; Ajit V. Sapre, W. Berlin, all of N.J.

[73] Assignee: Mobil Oil Corporation, Fairfax, Va.

[21] Appl. No.: 502,008

[22] Filed: Mar. 30, 1990

Related U.S. Application Data

[63] Continuation-in-part of Ser. No. 165,869, Mar. 3, 1988, abandoned.

[51] Int. Cl.[5] ..... C10G 11/00

[52] U.S. Cl. ..... 208/113; 208/48 Q; 208/118; 208/159; 208/160

[58] Field of Search ..... 208/113, 48 Q, 118, 208/159, 160

[56] References Cited

U.S. PATENT DOCUMENTS

| | | | |
|---|---|---|---|
| 3,617,497 | 11/1971 | Bryson | 208/74 X |
| 3,896,024 | 7/1975 | Nace | 208/74 |
| 4,422,925 | 12/1983 | Williams et al. | 208/74 X |
| 4,427,537 | 1/1984 | Dean et al. | 208/129 |
| 4,764,268 | 8/1988 | Lane | 208/161 X |
| 4,818,372 | 4/1989 | Mauleon et al. | 208/113 |
| 4,832,825 | 5/1989 | Mauleon et al. | 208/113 X |

*Primary Examiner*—Theodore Morris

*Attorney, Agent, or Firm*—Alexander J. McKillop; Malcolm D. Keen; Richard D. Stone

[57] ABSTRACT

A process for thermally and catalytically upgrading a heavy feed in a single riser reactor FCC unit is disclosed. A heavy feed is added to a blast zone in the base of the riser, and sufficient hot regenerated FCC catalyst is added to induce both thermal and catalytic cracking of the heavy feed. A reactive quench material, which cools the material discharged from the blast zone is added to a quench zone downstream of the blast zone, to reduce temperature at least in part by undergoing endothermic reactions in the riser. Quench liquids can be distillable FCC feeds such as gas oil, slack wax, or alcohols or ethers. The quench material is added in an amount equal to 100 to 1000 wt % of the non-distillable material in the heavy feed. A preferred catalyst, with a high zeolite content, is used which retains activity in the quench despite initial contact with the heavy feed, which tends to overwhelm conventional FCC catalysts.

9 Claims, No Drawings

CATALYTIC CRACKING OF COKE PRODUCING HYDROCARBONS

CROSS-REFERENCE TO RELATED APPLICATIONS

This application is a Continuation-In-Part of our prior co-pending application Ser. No. 165,869, filed on Mar. 3, 1988, and now abandoned, which is relied upon and incorporated herein by reference.

BACKGROUND OF THE INVENTION

This invention relates to methods of cracking hydrocarbon feedstocks in the presence of a cracking catalyst. More particularly, the invention relates to the fluid catalytic cracking of plural hydrocarbon feedstocks having diverse cracking characteristics.

A number of processes for the cracking of hydrocarbon feedstocks via contact at appropriate temperatures and pressures with fluidized catalytic particles are known in the art. These processes are known generically as "fluid catalytic cracking" (FCC).

Relatively, lighter molecular weight and lower boiling point hydrocarbons, such as gas oils, are typically preferred feedstocks for FCC operations. Such hydrocarbons generally contain fewer contaminants and have a lower tendency to produce coke during the cracking operation than heavier hydrocarbons. However, the relatively low content of such light hydrocarbons in many current crude mixes has lead to the attractiveness of heavier hydrocarbons, for example residual oils, as feedstocks to the FCC operation. One problem with the heavier hydrocarbons, however, is that these materials generally contain a higher level of metals which tend to contaminate the catalyst and increase the yield of coke during the cracking operation. In addition, the heavier hydrocarbons also tend to contain a greater abundance of coke precursors such as asphaltenes and polynuclear aromatics which result in increased coke lay.

Several attempts have been made to minimize the negative impact that heavy hydrocarbon feedstocks tend to have on FCC operation. For example, U.S. Pat. No. 4,552,645-Gartside et al eliminates the problem by avoiding the FCC unit altogether, instead routing the heavy hydrocarbon to a stripper/coker wherein such material is thermally cracked at high temperatures. U.S. Pat. No. 4,422,925-Williams et al is directed to an FCC process having a plurality of hydrocarbon feedstocks introduced at diverse locations in a riser type reactor in the presence of a zeolite catalyst. The lowest molecular weight feedstock is introduced in the bottom of the reactor. Hydrocarbon feedstocks having the highest tendency to form coke are introduced i the uppermost section of the riser and are exposed to the lowest reaction temperature and the lowest catalyst to oil ratios.

U.S. Pat. No. 4,218,306-Gross et al is assigned to the assignee of the present invention and is incorporated herein by reference. The disclosure of Gross is consistent with the Williams teaching insofar as it requires converting relatively low coke producing gas oils in a lower initial portion of a riser and then a higher coke producing feedstock, such a recycle oil, is introduced in an upper section of the riser.

In typical FCC configurations the feedstocks to be cracked were introduced either all together at the bottom of the riser or with the heavier fractions being introduced into the upper portions thereof. In direct contrast to the state of the art as presented by the above described patents, applicants have discovered that it is beneficial and desirable that the heavier, higher molecular weight hydrocarbon feedstocks, i.e., those feedstocks generally having a relatively high tendency to produce coke, be introduced into the riser at a location which is relatively upstream of the location at which the lighter, lower molecular weight feedstocks are introduced.

The methods of the present invention may also be used to optimize the slate of reaction products resulting from a single individual feedstock, independently of whether that feedstock is cracked alone or jointly with other individual feedstocks. For example, in certain refinery operating modes only a single unblended hydrocarbon stream may be available as FCC feedstock. According to one embodiment of the present invention, such a feedstock is first separated into light and heavy fractions. The separate fractions are then introduced into the reactor such that the heavy fraction enters the riser at a point relatively upstream of the light fraction. In this way, the conditions under which the light and heavy fractions are cracked may be optimally adjusted according to the teachings of the present invention.

According to certain preferred embodiments of the present invention, a relatively heavy hydrocarbon feedstock, such as residual oil, is used as a fresh feed to an FCC cracking unit for initially contacting suspended, hot and relatively active regenerated catalyst at an elevated temperature in a disperse phase catalytic conversion zone. Thereafter, a lighter hydrocarbon feedstock, such as gas oil, is injected into a downstream portion of the disperse phase suspension. Thus the relatively heavy hydrocarbon feedstock will be in contact with the catalyst for only a portion of the residence time available in the riser before coming in contact with a lighter hydrocarbon feedstock. Although it is contemplated that the heavy hydrocarbon may be introduced at any location within the riser provided its relative position to the lighter feedstock is maintained, according to certain preferred embodiments the relatively heavy hydrocarbon is introduced into the bottom of the riser where it is contacted with catalyst. The catalyst introduced into the bottom of the riser generally comprises freshly regenerated catalyst which enters the riser at an elevated temperature relative to the hydrocarbon feedstocks. The catalyst temperature entering the riser is generally greater than about 1100° F., preferably between about 1200° and 1450° F., while the temperature of the hydrocarbon feedstock is considerably less, generally less than about 800° F., preferably between about 300° and 600° F. Applicant has found that segregation of the feedstocks as taught by the present invention produces heavy hydrocarbon reaction temperatures which may be readily optimized according to the particular feedstock mix to be cracked. As the term is used herein, heavy hydrocarbon reaction temperature refers to the mix temperature in the heavy hydrocarbon reaction zone of the riser. As the term is used herein, heavy hydrocarbon reaction zone refers to the portion of the riser between the heavy hydrocarbon injection location and the light hydrocarbon injection location. As will be appreciated by those skilled in the art, the intimate contact between the heavy hydrocarbon and the hot catalyst which occurs at the entrance to the heavy hydrocarbon reaction zone will result in an initial heavy hydrocarbon/catalyst mix temperature which is between the temperature of the heavy hydrocarbon and the hot catalyst, depending upon the catalyst to oil ratio. For the purpose of convenience, the initial mix temperature in the heavy hydrocarbon reaction zone is herein defined as the initial adiabatic temperature of the mixture. This temperature is readily calculated by performing an enthalpy balance around the entrance to the heavy hydrocarbon reaction zone and by assuming no heat of reaction at the entrance. As is also understood by those skilled in the art, the temperature in the heavy hydrocarbon reaction zone generally decreases as the suspension passes upwardly through the zone and the endothermic reaction proceeds. Thus the temperature profile of the hydrocarbon/catalyst mix generally decreases continuously along the length of the heavy hydrocarbon reaction zone. The extent of the temperature decrease is a function of many parameters, including feedstock and catalyst characteristics and reaction zone configuration. The effect of these parameters and hence the mix temperature at the exit of the heavy hydrocarbon reaction zone can generally be estimated by those skilled in the art for any particular set of conditions. At the interface of the heavy hydrocarbon reaction zone and the light hydrocarbon reaction zone there will be a relatively discontinuous temperature drop due to the quenching effect of the light hydrocarbon feedstock. For the purpose of convenience, the initial mix temperature in the light hydrocarbon reaction zone is herein defined as the initial adiabatic temperature at the light hydrocarbon injection location. This temperature is readily calculated by performing an enthalpy balance around the entrance to the light hydrocarbon reaction zone and by assuming no heat of reaction at the entrance.

The methods of the present invention thus allow the heavier hydrocarbons to be initially cracked at temperatures which are higher than would otherwise be possible in a typical FCC process. Since only a portion, preferably a minor portion, of the total hydrocarbon charged to the riser is initially contacted with the hot, freshly regenerated catalyst, the temperature of the initial catalyst/hydrocarbon suspension is higher than the temperature which would result if both the heavy hydrocarbon and light hydrocarbon feedstocks were introduced together at a single location in the riser. Accordingly, one important aspect of the present invention resides in "blasting" the heavy hydrocarbon feedstock to catalyst mix temperatures which are higher than otherwise attainable without simultaneously subjecting the light feedstock or fractions to such unusually high temperatures. High temperature cracking of relatively heavy hydrocarbon feedstock increases the production of the preferred products at the expense of undesirable coke, without exposing the light hydrocarbons to such temperatures. Initial mix temperature in the heavy hydrocarbon reaction zone are preferably from about 1050° to about 1250° F., and more preferably from about 1100° F. to about 1200° F.

According to a further step of the present invention, a lighter hydrocarbon feedstock is introduced into the riser at a location which is downstream with respect to the heavy hydrocarbon feed injection location. The injection point for the light hydrocarbon feed is preferably selected to ensure that the contact time in the heavy hydrocarbon reaction zone or the blast zone of the riser is short relative to the contact time available in the entire riser. In this way, introduction of the lighter hydrocarbon feed into the suspension acts as a quench for the heavy hydrocarbon reaction and prevents overcracking which would otherwise occur at the relatively high temperatures existing in the heavy hydrocarbon reaction zone. Although applicant does not intend to be bound by or to any particular theory, applicant believes that processes according to the present invention result in vaporization and primary cracking of the asphaltenes, polynuclear aromatics, and other high molecular weight components of the heavy hydrocarbon feedstock at relatively high temperatures which promote the formation of desirable products at the expense of coke. Moreover, the period of contact at such relatively elevated temperatures, i.e., the contact time in the heavy hydrocarbon reaction zone, is made relatively short by the downstream introduction of the lighter hydrocarbon feedstocks which tend to quench the reaction and thereby reduce the reaction temperatures. In this way, undesirable secondary cracking of the reaction products produced in the heavy hydrocarbon reaction zone is minimized.

Accordingly, one important aspect of the present invention resides in reducing the temperature of the hydrocarbon/catalyst suspension at the exit of the heavy hydrocarbon reaction zone. Thus, injection of light hydrocarbon feedstock into the riser produces an initial light hydrocarbon reaction zoned temperature which is relatively low compared to the reaction temperature at the exit of the heavy hydrocarbon reaction zone. As the term is used herein , light hydrocarbon reaction zone temperature refers to the temperature in the light hydrocarbon reaction zone of the riser. For the purposes of convenience, the portion of the riser reactor down stream of the introduction of the light hydrocarbon feedstock is referred to as the "light hydrocarbon reaction zone", although this term is in no way limiting with respect to the type of hydrocarbon feedstocks which may be additionally introduced into the riser downstream of the light hydrocarbon feedstock injection location. At the interface of the heavy hydrocarbon reaction zone and the light hydrocarbon reaction zone there will be a relatively discontinuous temperature drop due to the quenching effect of the light hydrocarbon feedstock. For the purpose of convenience, the initial mix temperature in the light hydrocarbon reaction zone in herein defined as the initial adiabatic temperature at the light hydrocarbon injecting location. This temperature is readily calculated by performing a enthalpy balance around the entrance to the light hydrocarbon reaction zone and by assuming no heat of reaction at the entrance. Once again, the present invention is not limited to any particular temperature range in the light hydrocarbon reaction zone since this temperature will also be effected by many conditions, including but not limited to feedstock properties, desired FCC product rate and catalyst circulation rate. Nevertheless, applicant has found that the initial mix temperature in the light hydrocarbon reaction zone is preferably from about 950° to about 1050° F., and more preferably from about 980° to about 1020° F. In terms of quenching capacity, applicant has found that the introduction of the light hydrocarbon into the suspension is preferably sufficient to assure a reduction in suspension temperature of at least about 50° F., and more preferably at least about 100° F., with even better results achieved with even more quenching, e.g., there are benefits to operating with 150° to 250° F. of quench.

According to a further step required by some embodiments of the present invention, the hydrocarbon/catalyst suspension, after the introduction of the light hydrocarbon feedstock, is further passed through the riser reactor for a contact time which is relatively long compared to the contact time in the heavy hydrocarbon reaction zone. According to certain preferred embodiments, the contact time in the heavy hydrocarbon reaction zone is preferably less than about half the contact time in the light hydrocarbon reaction zone, and more preferably less than about one-third the contact time in the light hydrocarbon reaction zone. According to certain embodiments, the contact time in the heavy hydrocarbon reaction zone is preferably less than about one-fifth the contact time in the light hydrocarbon reaction zone.

BRIEF SUMMARY OF THE INVENTION

The present invention provides a catalytic cracking process wherein a heavy feed comprising non-distillable hydrocarbons is catalytically cracked in a riser reaction zone by contact with a source of hot, regenerated cracking catalyst to produce catalytically cracked products and spent cracking catalyst, cracked products are withdrawn as products, and spent cracking catalyst is regenerated in a catalyst regeneration means to produce hot regenerated cracking catalyst which is recycled t contact said heavy feed, characterized by: blasting in a blast zone in the base of the riser a heavy feed containing at least 10 wt % non-distillable hydrocarbons by contacting same with hot regenerated cracking catalyst at a cat:feed weight ratio of a least 5:1 and wherein the amount and temperature of the hot regenerated catalyst are sufficient to produce a catalyst/heavy feed mix temperature of at least 1050 F., and thereby inducing both thermal and catalytic reactions in said heavy feed; and quenching in a quench zone within said riser reactor within 2 seconds said mixture with a reactive quench material which undergoes endothermic reactions at the conditions present within said quench zone, and reactive quench is added in an amount at least equal to 100 wt % of said non-distillable hydrocarbons added to said blasting zone.

In another embodiment, the present invention provides a catalytic cracking process wherein a heavy feed comprising more than 10 wt % hydrocarbons boiling above 500 C. is catalytically cracked in a riser reaction zone by contact with a source of hot, regenerated cracking catalyst to produce catalytically cracked products including a viscous heavy fuel oil product and spent cracking catalyst, cracked products are withdrawn as products, and spent cracking catalyst is regenerated in a catalyst regeneration means to produce hot regenerated cracking catalyst which is recycled to contact said heavy feed, characterized by: blasting in a blast zone in the base of the riser said heavy feed by contacting it with hot regenerated cracking catalyst at a cat:feed weight ratio of a least 10:1 and wherein the amount and temperature of the hot regenerated catalyst are sufficient to produce a catalyst/heavy feed mix temperature of at least 1100 F., and induce both thermal and catalytic reactions in said heavy feed; said thermal reactions being sufficient to reduce the viscosity of said viscous heavy fuel oil product, quenching in a quench zone within said riser reactor within 1 second said mixture with a reactive quench material which undergoes endothermic reactions at the conditions present within said quench zone, said reactive quench being added in an amount equal to 100 to 1000 wt % of said non-distillable hydrocarbons added to said blasting zone and sufficient to quench the temperature by at least 150 F.; and recovering from said cracked products discharged from said riser reactor a heavy fuel oil product having a reduced viscosity.

In a more limited embodiment, the present invention provides a catalytic cracking process wherein a heavy feed containing at least 25 wt % resid is catalytically cracked in a riser reaction zone by contact with a source of hot, regenerated cracking catalyst to produce catalytically cracked products including a viscous heavy fuel oil product and spent cracking catalyst, cracked products are withdrawn as products, and spent cracking catalyst is regenerated in a catalyst regeneration means to produce hot regenerated cracking catalyst which is recycled to contact said heavy feed, characterized by: blasting in a blast zone in the base of the riser said heavy feed by contacting it with hot regenerated cracking catalyst at a cat:feed weight ratio of a least 15:1 and wherein the amount and temperature of the hot regenerated catalyst are sufficient to produce a catalyst/heavy feed mix temperature of at least 1200 F., and induce both thermal and catalytic reactions in said heavy feed; said thermal reactions being sufficient to reduce the viscosity of said viscous heavy fuel oil product, quenching in a quench zone within said riser reactor within 0.5 seconds said mixture with a gas oil or vacuum gas oil feed added in an amount equal to at least 200 wt % of heavy feed and sufficient to quench the temperature by at least 150 F.

DESCRIPTION OF THE PREFERRED EMBODIMENTS

Resid Blasting

For maximum effectiveness, it is beneficial if the resid feed, or heavy feed containing large amounts of resid, is subjected to unusually severe processing in the base of the riser reactor.

The unusual severity can be achieved by using conventional cat:oil ratios, but somewhat hotter catalyst, a severe preheating step, which preferably borders on visbreaking, or by contact with large amounts of catalyst. In most units, the preferred method of achieving blast conditions will be to operate with cat:oil ratios which are at least twice as high as those used for conventional cracking. While cat:oil ratios vary greatly from refinery to refiner, and vary greatly in the same unit in response to changes in unit operation, catalyst activity, or demand for products, those skilled in the art will be readily able in a given unit to double the cat to oil ratio over what had been conventionally used at that refinery for cracking of conventional feeds, e.g., gas oils, vacuum gas oils, or gas oils containing minor amounts of resid.

In most units, resid blasting requires operation with cat:oil ratios greater than 5:1, and it will usually be preferred to operate with cat:oil ratios exceeding 10:1 or 15:1, or even higher.

The cat:oil ratio in the blast zone will usually not be the same as the cat:oil ratio exiting the riser. This is because the present invention will generally produce a non-constant catalyst/oil ratio profile along the length of the riser. That is, the catalyst/oil ratio will decrease as more hydrocarbon is introduced downstream of the blast zone. Thus the blast zone is generally subject to catalyst/oil ratios which are greater than in any other place in the riser. It is possible to achieve blasting without resort to unusually high cat:oil ratios, by resort to severe preheating, or hotter catalyst, as discussed hereafter.

Severe preheating will ameliorate to some extent the need for more catalyst, or hotter catalyst. Thus it is preferred to operate with resid rich feed preheat exceeding the amount of preheat conventionally used, typically 300 to perhaps 700 F., i.e., with a feed preheat from 500 to 800 F., and even higher if the unit can achieve it. Severe preheating not only reduces the viscosity of the heavy feed, but also generates a certain amount of cutter solvent, and reactive fragments which are amenable, for a short time, to catalytic upgrading in the FCC. Expressed as ERT severity (Equivalent Reaction Time at 800 F., in seconds) it is preferred to operate with a feed which has been given a thermal treatment equivalent to from 100 to 1000 ERT seconds.

In many units it will also be possible to use hotter catalyst, and more conventional cat:oil ratios. Because of the large amounts of Conradson Carbon Residue associated with the heavy feeds contemplated for use herein, the regenerator will probably be pushed to a very high temperature in trying to burn all the coke produced by cracking a heavy feed containing a large amount of resid. It is also possible, and will be preferred in many instances, to use a two stage regenerator, which can produce catalyst of extremely high temperature. Such a two stage approach allows catalyst to be regenerated at extremely high temperature by performing the regeneration in two stages, the first stage at relatively moderate temperature, to burn off the fast coke and remove most of the water precursors. The second stage of regeneration can be at a much higher temperature, because it can be a relatively dry regeneration. Thus catalyst need only be thermally stable to retain activity, not hydrothermally stable.

Quench

It is essential to rapidly quench the heavy feed within no more than a second or two, or preferably even less, of the blasting stage. The nature and amount of quench fluid can be selected to reduce temperatures of resid rapidly and profoundly, preferably to reduce the temperature by at least 100 F., and more preferably by at least 150 F., and most preferably by at least 200 F., or more, within a period of no more than a second, preferably 0.5 seconds maximum, and most preferably within 0.2 seconds or less.

It is possible, but not preferred, to use conventional quench fluids, such as water, steam, or inert vaporizable liquids, such as cycle oils and slurry oils, or other aromatic rich streams. Although such quench fluids will remove heat from the blasted resid, and allow recovery of this heat in downstream processing operations, it converts relatively high grade energy into much lower grade heat. The worst scenario, from an energy conservation standpoint, is to convert the energy of blasted resid, at a temperature of around 950–1100F., to low grade condensing steam in the main column. Use of large amounts of water or steam quench also usually results in production of large amounts of sour water, which creates a disposal problem. Water also takes up a large portion of the volume of the FCC plant, and downstream vapor recovery equipment, e.g., addition of just 5% water to an FCC cracking a conventional feed such as VGO +5 or 10% resid results in about half of the riser reactor volume being occupied by steam.

Endothermic Quench

Use of a crackable, or at least reactive, quench liquid, which quenches the resid by promoting one or more endothermic reactions, is preferred. We discovered that it is both possible, and beneficial, to use as the quench fluid the conventional feed to a cat cracking unit, e.g, a gas oil or vacuum gas oil. Use of a conventional feed as a quench liquid is preferred for several reasons. The most significant reason is that most FCC units must crack a variety of feeds, ranging from resid rich feeds to more conventional stocks such as gas oils and vacuum gas oils and mixtures thereof, hereafter simply referred to as "VGO" for convenience. By using distillable, but crackable, stocks such as VGO as quench, unnecessary blasting and overcracking of VGO in the blasting zone is prevented or at least minimized. The VGO is effective at preventing overcracking of blasted resid, and the VGO is efficiently heated by superheated, blasted resid. The VGO, or other distillable, conventional feeds are never subjected to thermal cracking in the riser, because the temperatures experienced by the GO or VGO are similar to those experienced in units which operate without a resid blasting zone. It is irrelevant to the VGO that much of the heat needed to vaporize the VGO comes by desuperheating overheated resid and the products of blasting the resid, as opposed to vaporization of resid by removing sensible heat from hot, freshly regenerated catalyst.

It is preferred that the quench stream be at least 90% distillable, and preferably 95% distillable, and most preferably 100% distillable. It is especially preferred to have a splitter column just upstream of the cat cracker, to split the total feed into at least a heavy fraction, preferably containing over 90% of the non-distillable material fed to the cat cracker, and a lighter fraction, comprising at least 90% distillable hydrocarbons.

Other reactive quench fluids can also be used which will react with the resid, such as alcohols and ethers, and olefinic streams, provided that suitable catalysts are also present in a form and an amount which will promote the desired endothermic reaction. An additive quench fluid, such as an alcohol, may be used in addition to, or instead of, quenching with VGO and/or water or steam.

Riser Top Temperature

Although conditions at the base of the riser are far more severe than those associated with conventional FCC operations, the FCC unit at the top of the riser, and downstream of the riser, can and preferably does operate conventionally. When processing large amounts of resids, especially those which contains large amounts of reactive material which readily forms coke in process vessels and transfer lines, it may be preferable to operate with conventional, or even somewhat lower than normal riser top temperatures. Riser top temperatures of 950–1050 will be satisfactory in many instances.

Catalyst Activity

Conventional FCC catalyst, i.e., the sort of equilibrium catalyst that is present in most FCC units, can be used herein, but will not lead to optimum results. It is possible, by picking less than optimum conditions for blasting, and use of ordinary equilibrium FCC catalyst, to reduce conversion of GO or VGO enough so as to achieve little or no benefit overall, as far as conversion is concerned. By this is meant that the enhanced conversion of resid due to resid blasting can be largely or even completely offset by reduced conversion of conventional feed, unless care is taken to optimize the extent and severity of blasting, the amount of quenching, and catalyst activity.

For optimum results, it is important to use the following type of catalyst, or at least to add a significant amount of such catalyst to the unit's inventory.

The preferred catalysts are those which have a relatively high zeolite content, which should be in excess of 30 wt % large pore zeolite, and preferably approaching or even exceeding 50 wt % large pore zeolite. The large pore zeolite preferably has a relatively small crystal size, to minimize diffusion limitations. The zeolites should be contained in a matrix which has a relatively high activity, such as a relatively large alumina content. Especially preferred is use of a high activity matrix comprising at least 40 wt % alumina, on a zeolite free basis and having sufficient cracking activity to retain at least a 50 FAI catalyst activity within said quench zone. Ideally, a catalyst is used which retains at least a 55 FAI cracking activity within said quench zone.

The catalyst will also benefit from the presence of one or more metal passivating agents in the matrix.

The catalyst should also be formulated to have a relatively large amount of its pore structure as large macropores. Many catalysts having at least some of these properties have been developed, primarily for cracking resids mixed with conventional feeds. These resid cracking catalyst are highly preferred for use in the process of the present invention, because conventional equilibrium FCC catalysts now widely used can be overwhelmed by cracking resid rich fractions. Use of a catalyst having the preferred characteristics described above allows significant blasting of resid or other heavy feed in the base of the riser, while retaining enough activity to permit vigorous conversion of the reactive quench, e.g., VGO, added higher up in the riser.

Thermal Reactions

Even if the catalyst is rapidly deactivated by blasting resid, such that there is little or no overall gain in conversion or gasoline yield, the process of the present invention is still beneficial because of the improved properties of the heavy products. By subjecting the resid, or a resid rich fraction, to resid blasting, a significant amount of thermal conversion will occur, which will reduce the viscosity of the heavy product. Adding a heavy feed, comprising most or all of the non-distillables, to the resid blasting zone, allows a significant amount of visbreaking like reactions to be achieved in the base of the riser, while still achieving about the same overall conversion, and product properties such as gasoline yields and octane, as that achieved by other approaches, such as that disclosed in U.S. Pat. No. 4,818,372. The heavy fuel oil product of '372 will be more viscous than the heavy fuel oil product of our invention, because we achieve more visbreaking in the base of the riser reactor.

Conventional techniques can be used to calculate or estimate the amount of thermal reaction that occurs in the base of the riser, with some complications because of almost complete vaporization and endothermic catalytic reactions.

In general, it is believed beneficial to achieve thermal conversion of resid equal to roughly 50 to 1000, and preferably 100 to 700 ERT seconds in the riser blast zone. This will provide enough thermal cracking in the base of the riser to generate heavy "cutter stock" which will significantly reduce the viscosity of the heavy fuel oil product. Because of the difficulty of accurately determining ERT in the blast zone, and the importance of heavy fuel oil viscosity as a product specification, it may be preferable to adjust the blast zone severity so as to obtain at least a 10%, or 20%, or even higher, reduction in the viscosity of a specified heavy fuel oil fraction.

Additive Catalysts

In many instances it will be beneficial to use one or more additive catalysts, which may either be incorporated into the conventional FCC catalyst, added to the circulating inventory in the form of separate particles of additive, or added in such a way that the additive does not circulate with the FCC catalyst.

ZSM-5 is a preferred additive, whether used as part of the conventional FCC catalyst or is the form of a separate additive.

The ZSM-5 can be added as a once thru powder, downstream of blasting.

The ZSM-5 can be added as large, fast settling particles, which have an extended residence time in the riser. High silica additives, such as ZSM-5 do not deactivate nearly as quickly as the conventional catalyst in the riser, so they make high desirable additives for use in the process of the present invention.

Feed Composition

The present invention is applicable for use with all FCC feedstocks. It is contemplated, however, that the present invention will most frequently be used with hydrocarbon feedstocks capable of producing relatively large proportions of gasoline, gasoline blending components, distillates and distillate blending components. Feedstocks of this type generally include liquid hydrocarbon feeds. As used herein, the term liquid hydrocarbon refers to those hydrocarbons which are liquid at standard conditions. Accordingly, the light and heavy hydrocarbons of the present invention are each preferably selected from the group consisting of residual gas oils, atmospheric gas oils, vacuum gas oils, coker gas oils, catalytic gas oils, hydrotreated gas oils, naphthas, catalytic naphthas, topped crudes, deasphalted oils, hydrotreated resids (HDT resids), hydrocracked resids, shale oil and mixtures of these. The light hydrocarbon feedstock is even more preferably selected from the group consisting of atmospheric gas oils, vacuum gas, coker gas oils and mixtures of these. The heavy hydrocarbon feedstocks of the present invention are even more preferably selected from the group consisting of residual gas oils, topped crudes, deasphalted oils, HDT resids, hydrocracked resids, shale oil, hydrocarbons having an API gravity of less than about 20°, hydrocarbons having an average molecular weight of greater than about 300, hydrocarbon s having an initial boiling point of greater than about 700° F., hydrocarbons having a CCR content of greater than about 1 wt %, and mixtures of these.

The feeds which will benefit most from the practice of the present invention are similar to those described in U.S. Pat. Nos. 4,818,372 and 4,427,537, namely those feeds which contain at least 10 wt % material boiling above about 500 C., and preferably those which contain 20, 25, 30% or more of such high boiling material. Especially beneficial results are seen when the heavy feed contains 50 wt % or more material boiling above 500 C.

A highly preferred chargestock comprises a mixture containing at least 50 wt % resid, diluted or mixed with a minority of a lighter, more viscous chargestock, such as a gas oil, a vacuum gas oil, or even a heavy naphtha material.

A mixture of resid, and conventional FCC recycle streams, such as light cycle oil, heavy cycle oil, or slurry oil, can also be used. In this instance, the FCC recycle stream acts primarily as a diluent or cutter stock whose primary purpose is to thin the resid feed, to make it easier to pump and to disperse into the resid blasting zone.

Quench Feed Composition

As previously discussed, use of a crackable, or at least reactive, quench liquid, which quenches the resid by promoting one or more endothermic reactions, is preferred.

The quench feeds can be divided into three categories:

1. Conventional FCC feeds (or fractions)
2. Unconventional hydrocarbon feeds
3. Reactive non-hydrocarbons.

Conventional FCC feeds, e.g, a gas oil or vacuum gas oil which should be entirely distillable, can beneficially be used as quench. These are merely the conventional feeds to a cat cracking unit, and by using them as quench they can simultaneously be cracked and used as good quench fluids. The quench feed can also be split into multiple fractions, i.e., with the resid being blasted in the base of the riser, quenched within 0.5 to 1.0 seconds with vacuum gas oil, and quenched again within another 0.5 to 1.0 seconds additional residence time with a gas oil boiling range feed. This splitting of the quench feed by boiling range, and adding the lighter fractions higher up in the riser allows the quench operation to be fine tuned to the resid, the amount of resid blasting required, and the overcracking or resid and/or vacuum gas oil quench which is required or can be tolerated.

Unconventional hydrocarbon feeds means those materials which are not conventionally fed to an FCC unit. One of the exceptional quench materials is any highly paraffinic material, such as wax, or slack wax. These materials are not usually considered as suitable feeds for conventional FCC processing, but they are uniquely suited for use herein. These paraffinic feeds are fairly difficult to crack, and are relatively low coking. The hot catalyst and blasted resid effectively vaporizes and cracks this paraffinic material, but the paraffins do not deactivate the catalyst as much as conventional feeds, such as a vacuum gas oil. The waxy feeds especially make unusual amounts of olefins, and large amounts of relatively high octane olefinic gasoline, especially when compared to gasoline yields obtained by cracking more aromatic feeds such as VGO. Use of a paraffinic quench, perhaps followed by additional quenching steps with reactive feeds, conventional distillable hydrocarbon feeds, or inerts such as water, leads to effective resid blasting and efficient paraffin cracking, and increased yields of valuable light products.

Other unconventional hydrocarbon feedstocks which make efficient quench streams include other easily crackable or upgradeable hydrocarbons boiling below the gas oil range. Naphthas, light straight run naphthas, reformer feeds, and normal paraffin rich streams rejected by C5 or C6 isomerization units are especially effective quench streams.

Unconventional hydrocarbon quench streams also include the normally gaseous hydrocarbons, such as dry gas or wet gas streams generated around the cat cracking unit, or light olefinic streams available from other sources.

Reactive non-hydrocarbons which can be used as quench fluids include alcohols and ethers, provided that suitable catalysts are also present in a form and an amount which will promote the desired endothermic reaction. In most instances, the FCC catalyst will be sufficient to promote these reactions. An additive quench fluid, such as an alcohol, may be used in addition to, or instead of, quenching with VGO and/or water or steam.

Use of a reactive fluid for quenching, wherein some heat removal is accomplished via an endothermic reaction, will not be quite as prompt as simply dumping a heat sink, such as water in. The slight reduction in quenching speed is not of great concern, especially when only the heaviest fractions of the feed are subjected to blast conditions. When rapid quenching is of concern, it is also possible to combine endothermic quench with heat sink quench, i.e., to quench first with VGO or GO, then quench again with water or cool catalyst or some other heat sink, so that severe thermal processing of GO or VGO can be avoided. The somewhat slower quenching achieved via an endothermic reaction can also be accommodated to some extent by starting the injection of reactive quench liquid (the VGO feed, slack, an alcohol, or a mixture of one or more) a little sooner than would be done if water or some inert fluid were being used as the quench liquid.

Blast Feed/Quench Feed Ratios

The reactive quench (whether a conventional, distillable hydrocarbon feed, an unconventional hydrocarbon feed, or a reactive non-hydrocarbon) should be as large a stream, on a molar or on a weight basis, as the heavy feed added to the resid blasting zone. Preferably the reactive quench is present in an amount equal to 100 to 1000 wt % of the non-distillable material added to the resid blasting zone, more preferably 150 to 750 wt %, and most preferably 200 to 600 wt % of the non-distillable feed to the resid blasting zone.

If the heavy feed to the resid blasting zone comprises 50 wt % resid, and 50 wt % distillable material, then 1 to 10 weights of reactive quench should be used for each weight of resid feed. Expressed as ratios of quench to heavy feed, where the heavy feed includes both the resid and any distillable material mixed in with the resid, the quench to heavy feed weight ratio, for the heavy feed just described, should be 0.5 to 5.0, preferably 0.75 to 3.75, and most preferably 1 to 3 weights of reactive quench per weight of total heavy feed to the base of the riser.

EXAMPLE 1

A pilot scale FCC riser reactor having a constant internal diameter of about 0.25 inches and an overall length of about 20 feet was provided. A light Arab virgin gas oil (LAVGO) having an API gravity of about 24.0, an average molecular weight of about 384 and a wt % CCR of about 0.3 was introduced along with an equilibrium commercial FCC catalyst (Filtrol 75F) having a micro activity test (MAT) of about 65. At the inlet of the reactor the hydrocarbon partial pressure was about 14 psia. The contact time in the reactor was about 1.8 seconds at a temperature of about 1000° F.

The crackability, conversion, coke make and gasoline make of the LAVGO at various catalyst/oil ratios were found to be as shown in Table 1. As the term is used herein, volume percent conversion of an FCC feedstock is defined as follows:

$$\text{Conversion} = 100 - (HFO + LFO)$$

where:

HFO = Vol % Heavy Fuel Oil

LFO = Vol % Light Fuel Oil

As used herein, crackability is defined as follows:

$$\text{Crackability} = \text{Conversion}/(100 - \text{conversion})$$

TABLE 1

| Light Arabian Vacuum Gas Oil | | | | |
|---|---|---|---|---|
| Catalyst/Oil (Wt/Wt) | Crackability | Volume % Conversion | Weight % Coke | Volume Gasoline |
| 7 | 1.9 | 66 | 3.9 | 54.5 |
| 10 | 3.1 | 76 | 5.1 | 61.5 |

EXAMPLE 2

A light Arab atmospheric resid (LAAR) having an API gravity of about 17.9, an average molecular weight of about 515 and a wt % CCR of about 6.4 was cracked at catalyst/oil ratios of about 4.2, 5.1 and 8 under conditions otherwise identical to those described in Example 1. The results of these runs are indicated in Table 2 below.

TABLE 2

| Light Arab Atmospheric Resid | | | | |
|---|---|---|---|---|
| Catalyst/Oil (Wt/Wt) | Crackability | Volume % Conversion | Weight % Coke | Volume Gasoline |
| 4.2 | 1.2 | 55 | 6.8 | 46 |
| 5.1 | 1.7 | 64 | 7.5 | 53.5 |
| 8 | 2.4 | 70 | 9.1 | 56 |

A comparison of Tables 1 and 2 indicates that as a function of catalyst to oil ratio the crackability of the heavier resid containing feed, i.e., the LAAR, is slightly higher than that of the gas oil alone. The comparison also reveals that the resid containing feed produces much more coke than the LAVGO. As in is well understood by those skilled in the art, heat balanced operation generally requires a reduction in catalyst to oil ratio to compensate for the increased coke make. In heat balanced operation, therefore, the increase in coke production tends to reduce the crackability of the feedstock and hence inhibit cracking of all the components in the feed. Accordingly, a comparison of Examples 1 and 2 indicates that conversion of the heavy hydrocarbon feedstock would be higher if coke make were reduced. A comparison of Examples 1 and 2 also indicates that, under heat balanced FCC operating conditions, the coke precursors in the LAAR resid containing material contribute to low yields of gasoline.

EXAMPLE 3

A hydrocarbon feedstock blend consisting essentially of 80 wt % Beryl vacuum gas oil (BVGO) and 20 wt % Beryl vacuum resid (BVR) was provided to the riser FCC pilot unit described in Example 1. The feedstock blend had an API gravity of about 22.2, a molecular weight of about 458 and a wt % CCR of about 3.3. The feedstock was contacted in the riser for about 0.8 seconds with an equilibrium commercial FCC catalyst (Davison RC25) having a MAT of about 69. The inlet hydrocarbon partial pressure was maintained at about 20 psia. The results from tests conducted at reaction temperatures of about 1000.F and about 1075.F are summarized below in Tables 3 and 4.

TABLE 3

| Vacuum Gas Oil/Vacuum Resid Blend at 1000° F. | | | |
|---|---|---|---|
| Weight % Conversion | Volume % Coke | Volume % Gasoline | Volume % Gasoline Plus Alkylate |
| 56.5 | 4.5 | 46 | 64 |
| 59 | 4.75 | 47 | 67 |
| 69 | 5.9 | 54.5 | 79 |
| 69 | 6.3 | 55.5 | 78 |
| 71 | 6.4 | 55 | 81 |

TABLE 4

| Vacuum Gas Oil/Vacuum Resid Blend at 1075° F. | | | |
|---|---|---|---|
| Volume % Conversion | Weight % Coke | Volume % Gasoline | Volume % Gasoline Plus Alkylate |
| 62 | 4.4 | 45 | 70 |
| 62.5 | 4.6 | 47 | 70 |
| 68 | 4.8 | 50 | 79 |
| 73.5 | 5.9 | 53.5 | 85 |

An analysis of Tables 3 and 4 indicates that, at approximately the same conversion level, coke production generally decreases as reaction temperatures increase. This data also indicates that for approximately constant coke production, gasoline selectivity is not substantially reduced when high temperature cracking is utilized. Moreover, this data also indicates that the yields of gasoline plus alkylate increase with higher temperature cracking under heat balanced, i.e., constant coke yield, FCC conditions. In summary, therefore, Example 3 indicates that an increase in the cracking temperature of a relatively heavy hydrocarbon FCC feedstocks provides improved gasoline selectivity and a reduction in the amount of coke produced.

EXAMPLE 4

A relatively light FCC hydrocarbon feedstock consisting essentially of 100% vacuum gas oil is provided. A relatively heavy FCC hydrocarbon feedstock consisting essentially of 25 vol. % vacuum resid and 75 vol. % vacuum gas oil is also provided. The heavy feedstock and the light feedstock, each at approximately 300° F., are introduced together in the bottom of a riser reactor in a heavy feedstock: light feedstock ratio of about 4:6 on a volume basis. The feedstocks are contacted with an equilibrium catalyst at a temperature of about 1310° F. Sufficient catalyst is introduced into the riser to produce a catalyst/oil weight ratio of about 7.4 and an initial catalyst/hydrocarbon mix temperature of about 1060° F. The length of the riser is sufficient to give a total contact time of approximately about 2 seconds. The conversion, gasoline, alkylate, 650° F.+ and coke yields expected from such an operation are as follows: 71 vol % conversion; 52 vol % gasoline; 28 vol % alkylate; 10 vol % 650° F.+ and 6 wt % coke.

EXAMPLE 5

The heavy and light hydrocarbon feedstocks described in Example 4 are provided. The heavy hydrocarbon feed, i.e., the feed comprising 25 vol % vacuum resid, is injected at the bottom of the same riser into the same catalyst circulation stream described in Example 4. The contact between the heavy hydrocarbon feed at 300° F. and the recirculating catalyst at 1310° F. produced a initial heavy hydrocarbon mix temperature of about 1220° F. and a catalyst/oil ratio of about 18.5. At a second injection point located approximately one-tenth of the total reactor length above the bottom injection nozzles, the relatively light hydrocarbon feed is introduced into the suspension, thereby quenching the reaction temperature to about 1020° F. Accordingly, the heavy hydrocarbon feedstock is cracked in the heavy hydrocarbon reaction zone at relatively elevated temperatures for approximately 0.2 seconds. On the other hand, the light hydrocarbon feed will experience essentially conventional cracking for about 1.8 seconds in the light hydrocarbon reaction zone. The expected conversion, and gasoline, alkylate, 650° F.+, and coke yields resulting from this operation are as follows: 72.51 vol % conversion; 52 vol % gasoline; 34 vol % alkylate; 9.4 vol % 650° F.+; and 6 wt % coke.

EXAMPLE 6

This example shows the amount of viscosity reduction that can be achieved due to higher mix temperatures in a riser cracking FCC using. The feed was a conventional VGO, having a viscosity of 26 centistokes. the following table shows the viscosity of a given heavy fuel oil product, as a function of the mix temperature of catalyst and oil in the base of a riser FCC unit.

| Tmix | Viscosity |
|---|---|
| 600 C. | 15.7 cs |
| 770 C. | 13.1 cs |
| 840 C. | 10.1 cs |

DISCUSSION

It will be recognized by those skilled in the art that the process of the present invention calls for an unusual operation of the FCC unit. The heavy feed becomes a minority feed stream, and the quench outweighs the heavy feed, often by a substantial amount. Such an unusual mode of operation is necessary to achieve the desired blasting, and thermal upgrading, of the heavy feed to the base of the riser, without overcracking the other feed components. By resorting to such unusual operating procedures it is possible to make a conventional FCC unit operate as if it had a visbreaker embedded in the base of the riser, which visbreaker operated selectively on the heavy fuel oil product. An FCC unit of the present invention can achieve a significant amount of visbreaking of heavy feed, with essentially none of the capital or operating expenses of a visbreaker. No separate visbreaker heater is required, there is no fractionator associated with the visbreaker, and no production of relatively low value products, such as the thermally cracked gasoline usually produced by a visbreaker.

Use of conventional FCC feeds as the reactive quench allows these feeds to be cracked efficiently, while quenching the thermal reactions occurring in the resid blasting zone. When the preferred high activity, high zeolite content catalysts are used, there is little or no penalty associated with first exposing the catalyst to resid, and then using this same catalyst to crack, e.g., VGO.

Use of unconventional quench materials, whether hydrocarbon derived (such as slack wax) or non-hydrocarbon (alcohols) allows additional sophisticated upgrading of these materials, in an efficient manner, in a more or less conventional unit. Slack wax can be efficiently converted into gasoline, and thereby upgraded from a low value product to much more valuable lighter hydrocarbons.

Use of our preferred process allows any quenched riser FCC process to operate at maximum effectiveness.

Although the invention has been described in terms of a riser reactor, which are the ones in widespread use commercially, the process also works with equal effectiveness in a downflow reactor.

We claim:

1. A catalytic cracking process wherein a heavy feed comprising non-distillable and distillable hydrocarbons is catalytically cracked in a riser reaction zone by contact with a source of hot, regenerated cracking catalyst to produce catalytically cracked products and spent cracking catalyst, cracked products are withdrawn as products, and spent cracking catalyst is regenerated in a catalyst regeneration means to produce hot regenerated cracking catalyst which is recycled to contact said heavy feed, characterized by:

fractionating said heavy feed into at least a heavy fraction containing at least 10 wt % non-distillable hydrocarbons and at least one lighter fraction containing distillable hydrocarbons;

blasting in a blast zone in the base of the riser said heavy fraction by contacting same with hot regenerated cracking catalyst at a cat:feed weight ratio of a least 5:1 and wherein the amount and temperature of the hot regenerated catalyst are sufficient to produce a catalyst/heavy fraction mixture having a temperature of at least 1050 F., and thereby inducing both thermal and catalytic reactions in said heavy fraction; and quenching said mixture in a quench zone within said riser reactor within 2 seconds with said at least one lighter fraction containing distillable hydrocarbons which undergoes endothermic reactions at the conditions present within said quench zone, said reactive quench added in an amount at least equal to 100 wt % of said non-distillable hydrocarbons added to said blasting zone.

2. The process of claim 1 wherein the quench is selected from the group of hydrocarbon feeds boiling in the gas oil and vacuum gas oil range, naphtha boiling range hydrocarbons, and normally gaseous hydrocarbons.

3. The process of claim 1 wherein said reactive quench is added in an amount equal to 100 to 1000 wt % of said non-distillable hydrocarbons added to said blasting zone.

4. The process of claim 1 wherein said reactive quench is added in an amount equal to 200 to 750 wt % of said non-distillable hydrocarbons added to said blasting zone.

5. The process of claim 1 wherein said heavy fraction comprises at least 50 wt % material boiling above 500 C.

6. The process of claim 1 wherein the quenching zone reduces temperatures at least 100 F. within 0.5 seconds.

7. The process of claim 1 wherein the quenching zone reduces temperatures at least 150 F. within 0.5 seconds.

8. The process of claim 1 wherein the quenching zone reduces temperatures at least 200 F. within 0.5 seconds.

9. The process of claim 1 wherein a non-reactive quench fluid is added to said quench zone in addition to said reactive quench, and said non-reactive quench fluid is present in an amount equal to 10 to 100 wt % of said non-distillable feed added to said blast zone.

* * * * *